United States Patent [19]

Bludworth

[11] 4,013,032

[45] Mar. 22, 1977

[54] OCEAN GOING PUSH-TOWING COMBINATION

[76] Inventor: Robert A. Bludworth, P.O. Box 12424, Houston, Tex. 77017

[22] Filed: Dec. 8, 1975

[21] Appl. No.: 638,542

Related U.S. Application Data

[63] Continuation of Ser. No. 208,604, Dec. 16, 1971, abandoned.

[52] U.S. Cl. ..... 114/248 R; 114/77 R

[51] Int. Cl.[2] ..... B63B 21/00

[58] Field of Search ..... 114/235 R, 235 A, 77 R; 213/75 R, 224; 248/223, 225

[56] References Cited

UNITED STATES PATENTS

| | | | |
|---|---|---|---|
| 1,458,134 | 6/1923 | Constan | 114/235 A |
| 3,362,372 | 1/1968 | Peterson | 114/235 R |
| 3,486,476 | 12/1969 | Breit | 114/235 R |
| 3,568,621 | 3/1971 | Kawasaki | 114/235 R |
| 3,610,196 | 10/1971 | Lowry | 114/235 R |
| 3,613,628 | 10/1971 | Garcia | 114/235 R |
| 3,735,722 | 5/1972 | Hooper et al. | 114/235 R |

*Primary Examiner*—Trygve M. Blix
*Assistant Examiner*—Galen L. Barefoot

[57] ABSTRACT

A marine transportation combination including a first vessel and a second vessel, the second vessel having a notch or slip for receiving the first vessel, the respective vessels being mated together by three individual couplings, two of which are located on the sides of the first vessel and the wings of the notch, the third being disposed between the bow of the first vessel and the central portion of the notch, the couplings being substantially instantaneously engagable and disengagable thereby providing substantially instantaneous mating and unmating of the vessels, there further being interengagable structural formations to prevent lateral outward spreading of the wings when the vessels are mated.

7 Claims, 12 Drawing Figures

ROBERT A. BLUDWORTH
INVENTOR.

BY Ralph R. Browning
C. James Bushman
ATTORNEYS

ROBERT A. BLUDWORTH
INVENTOR.

BY Ralph R. Browning
C. James Bushman
ATTORNEYS

ROBERT A. BLUDWORTH
INVENTOR.

BY Ralph R. Browning
C. James Bushman
ATTORNEYS

OCEAN GOING PUSH-TOWING COMBINATION

This is a continuation, of application Ser. No. 208,604, filed 12/16/71, now abandoned.

BACKGROUND OF THE INVENTION

The present invention relates to marine transportation combinations and more specifically to intergrated push-towing combinations for use in open seas.

The use of marine push-towing combinations such as tugs and barges is widely accepted as an efficient, economical means of transporting cargo from one location to another. The utilization of separate vessels, one furnishing power, the other carrying cargo, allows more efficient use of the powered vessel inasmuch as when the cargo vessel has been moved to the desired destination, the powered vessel need not remain idle while the cargo is being unloaded. Thus for example, the powered vessel can be used to transport another cargo vessel to some other destination. Such an arrangement also leads to more efficient use of the crew of the powered craft. In typical powered, ocean going cargo ships, when the ship reaches its destination, the crew of the ship is relatively idle while the cargo is being unloaded by longshoremen. This of course increases the cost of shipping which is already rising at a very rapid rate due to the increased cost of construction of ships and the maintenance thereof.

Thus, while articulated vessels, i.e., ships consisting of several units as for example a cargo vessel separate from a power vessel, possess distinct advantages, their use has been limited to inland waterways such as rivers, lakes and protected bays. Such articulated vessels have not been satisfactory for ocean going shipments due primarily to the action of winds, waves, and tides which are encountered in such environments. Several articulated combinations have been proposed for open water use such as those shown in U.S. Pat. Nos. 3,362,372 and 3,486,476. These prior art systems and other similar ones suffer from the disadvantage that engagement and disengagement of the powered vessel and the cargo vessel cannot be accomplished as rapidly as is necessary in the event the powered vessel needs to unmate from the cargo vessel for safety reasons. Moreover, most of the prior art marine combinations proposed for such use have not provided a means whereby the coupling between the powered and the cargo vessel is rigid such that the two craft will act as a unitary vessel when they are mated.

SUMMARY OF THE INVENTION

It is therefore an object of the present invention to provide an improved apparatus for marine transportation.

Another object of the present invention is to provide a marine push-towing combination in which a powered vessel is rigidly secured to a cargo vessel.

Yet another object of the present invention is to provide a marine transportation combination in which at least two vessels are joined by locking means which provide substantially simultaneous engagement and disengagement thereby permitting substantially simultaneous mating and unmating of the vessels.

A specific object of the present invention is to provide an articulated ship suitable for open water cargo transportation, the articulated ship comprising a powered vessel and a cargo vessel releasably secured together by locking means which are substantially simultaneously engageable and disengageable providing substantially simultaneous mating and unmating of the powered vessel and the cargo vessel.

Still another object of the present invention is to provide a marine push-towing combination comprised of a powered vessel and a cargo vessel and having a locking means for releasably securing the vessels together which provides substantially simultaneous engagement and disengagement thereby permitting substantially simultaneous mating and unmating of the powered vessel from the cargo vessel.

These and other objects of the present invention will become apparent from the description given herein, the drawings, and the appended claims.

In one aspect the above objects are accomplished by a marine transportation combination comprising first and second vessels, the second vessel having a docking means or slip for receiving the first vessel, there being further provided at least three locking means for rigidly coupling the first and second vessels together when they are mated.

In another, more specific aspect, the present invention provides a marine push-towing combination especially suited for use in open water wherein a cargo vessel has a docking means or slip for reception of a powered vessel and wherein there are at least three locking means for rigidly coupling the powered vessel to the cargo vessel when the former is recieved into the docking means of the latter.

The locking means employed with the marine combinations set forth herein are designed to be substantially simultaneously engageable and disengageable to permit substantially simultaneous mating and unmating of the respective vessels.

While the marine transportation combination disclosed herein is described below with specific reference to a powered vessel and a cargo vessel to thereby form a push-towing combination, it is to be understood, as noted above, that the marine transporation combination is equally spplicable to two or more unpowered vessels such as for example two of more barges or other such cargo carrying vessels.

DESCRIPTION OF THE PREFERRED EMBODIMENTS

Figure 1:
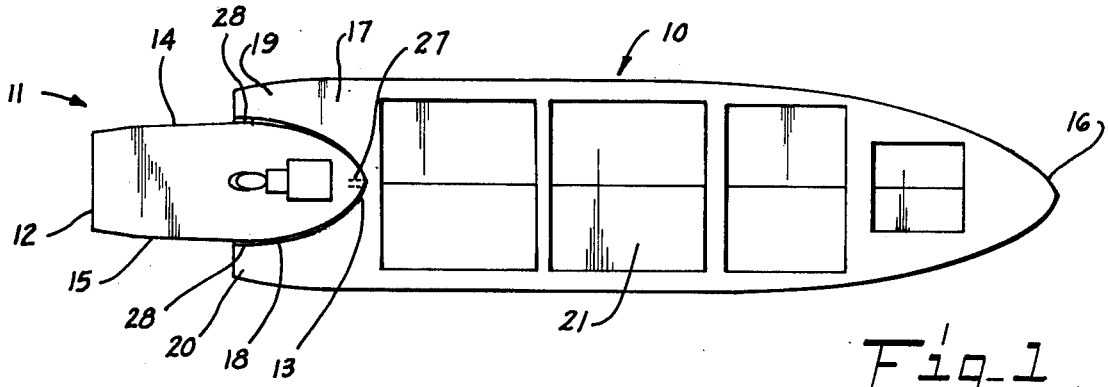
FIG. 1 is a top planar view of one embodiment of the marine push-towing combination of the present invention.
Figure 2:
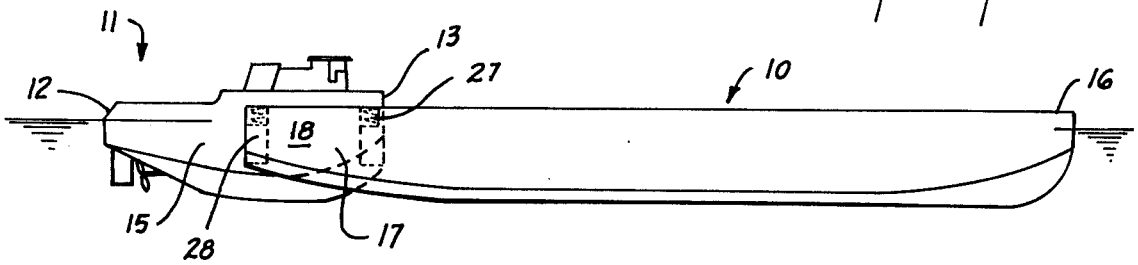
FIG. 2 is an elevational view of the combination shown in FIG. 1.

Referring now to the drawings and in particular to FIGS. 1 and 2, it is seen that the articulated ship of the present invention comprises a suitable cargo vessel shown generally at 10 and a suitable powered vessel shown generally at 11 coupled together by four locking means 27 and 28 (described in detail below) to form a substantially unitary ocean going craft. Powered vessel 11 includes a stern portion 12, a bow portion 13 and sides 14 and 15. Cargo vessel 10, having suitable cargo hatches 21, includes a bow portion 16 and a stern portion 17, stern portion 17 having a notch or slip 18 therein thereby providing a pair of rearwardly extending stern wings 19 and 20, notch 18 serving as a docking means for powered vessel 11. When powered vessel 11 and cargo vessel 10 are in the mated position as in FIG. 1, a portion of powered vessel 11 is received into notch 18 between stern wings 19 and 20. Notch 18 has a configuration which conforms substantially to that of the docked or mated portion of powered vessel 11.

Figure 3:
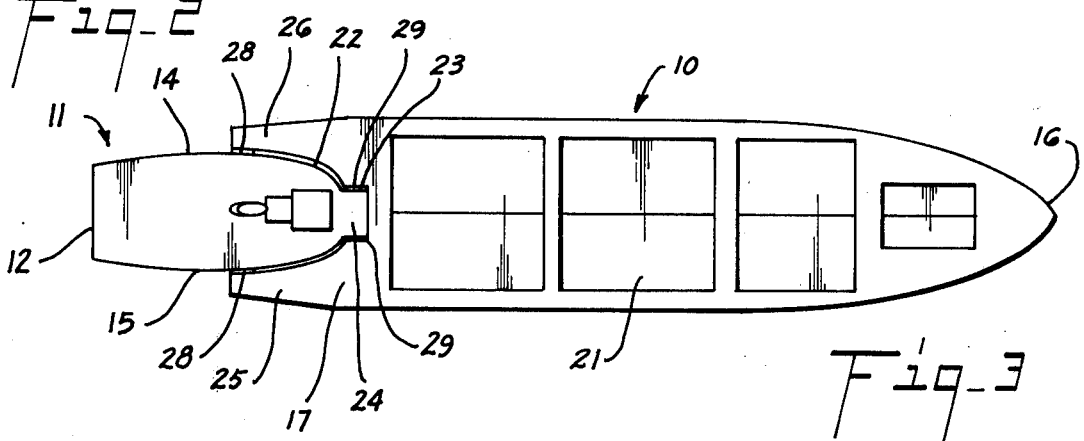
FIG. 3 is a top planar view of another embodiment of the marine push-towing combination of the present invention.
Figure 4:
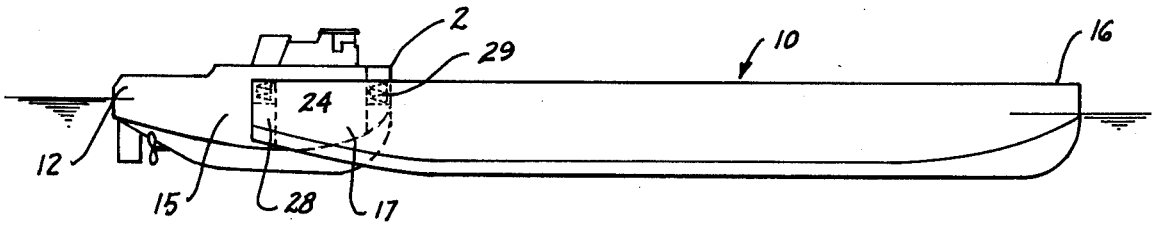
FIG. 4 is an elevational view of the combination shown in FIG. 3.

In FIGS. 3 and 4 there is shown an articulated ship quite similar to that shown in FIGS. 1 and 2, but wherein the notch or docking means provided by cargo vessel 10 is of a slightly different configuration. As seen best in FIG. 3, notch 22 includes a rectangular recess 23 opening into notch 22, rectangular notch 23 receiving the protruding, squared-off bow 24 of powered vessel 11 when powered vessel 11 is received into notch 22 between stern wings 25 and 26. In general, and as seen in FIG. 1 and 3, the notch or slip in the stern portion of the cargo vessel 10 will have a shape which generally conforms to the configuration of the portion of the powered vessel 11 received therein. It is to be understood, however, that the particular shape of the notch or slip can vary, the only requirement being that at least three locking means, as hereinafter described, be used to mate together the powered vessel and the cargo vessel.

In the articulated ship of the present invention, the locking means coupling powered vessel 11 to cargo vessel 10 are substantially simultaneously engageable and disengageable such that mating and unmating of cargo vessel 10 and powered vessel 11 can be accomplished quickly. As noted, while only three locking means need be employed, it is generally preferable that there be at least four locking means, a typical arrangement being one between each side of the powered vessel and the wings defining the notch in the cargo vessel 10 and two between the bow of the powered vessel and the cargo vessel at approximately the innermost part of the notch in the cargo vessel 10.

Figure 7:
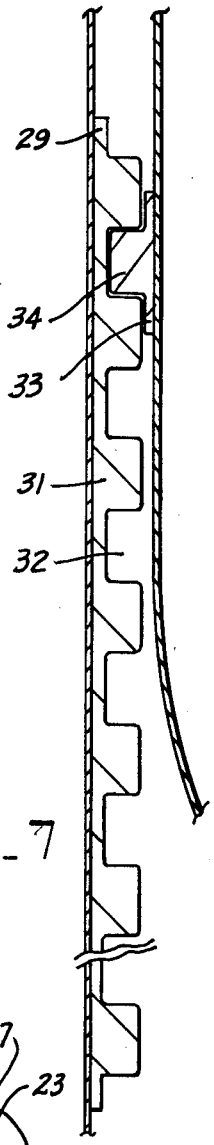
FIG. 7 is an elevational, sectional view showing a typical locking means arrangement between the side of the powered vessel and the cargo vessel.
Figure 8:
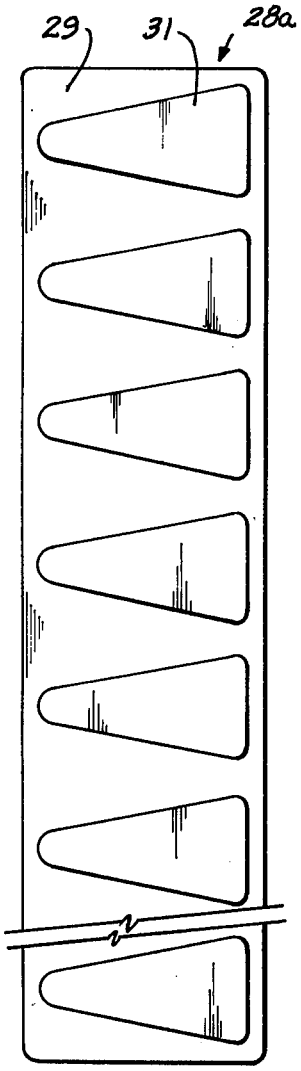
FIG. 8 is an elevational view of one embodiment of cargo vessel portion of the locking means.
Figure 9:
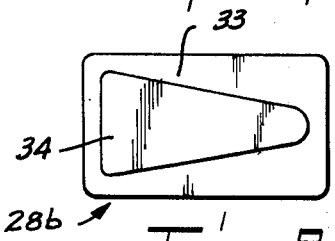
FIG. 9 is an elevational view of one embodiment of the powered vessel portion of the locking means.

Reference is now made to FIGS. 7, 8, and 9 for a detailed description of the side locking means 28 shown in FIGS. 1 and 2, 3 and 4. In general, locking means 28 comprises interlocking wedge-shaped members mounted on cargo vessel 10 and powered vessel 11 which are frictionally engageable. For purposes of clarity, locking means will be described in terms of parts 28*a* and 28*b*, part 28*a* being secured to cargo vessel 10, part 28*b* being secured to powered vessel 11. Part 28*a* is seen to comprise a mounting plate 29 fastened to the inside wall 30 of wing 19, it being understood that like assemblages are fastened to the inside walls of wings 20, 25, and 26. Protruding outward from the flat surface of plate 29 and into notch 18, or 22 as the case may be, are a plurality of tapered or wedge-shaped members 31. Cargo vessel, wedge-shaped members 31, as best seen in FIG. 8, are vertically displaced from one another and form between them a plurality of wedge-shaped channels 32 which are also vertically displaced from one another, channels 32 having substantially the same volume and shape as member 31. Wedge-shaped members 31 are disposed such that the smaller ends point aft of cargo vessel 10 and the larger ends point fore of cargo vessel 10.

Part 28*b* of locking means 28 comprises a mounting plate 33 having protruding therefrom a wedge-shaped or tapered member 34, the larger end of wedge-shaped member 34 pointing aft of powered vessel 11, the smaller end of wedge-shaped member 34 pointing fore of powered vessel 11. Plate 33 is mounted to the side 15 of powered vessel 11 with powered vessel, wedge-shaped member 34 extending outward from the side wall 15 of powered vessel 11, it being understood that a like assemblage is mounted on the side 14 of powered vessel 11. While mounting plates 29 and 33 have been described as if they were separate from members 31 and 34, it is to be understood that in the usual practice, they will form an integral unit the whole assemblage usually being cast. Moreover, it is possible that members 31 and 34 can be made an integral part of the respective walls or sides of the powered vessel 11 or cargo vessel 10.

When powered vessel 11 and cargo vessel 10 are in the mated position as is shown in FIGS. 1 or 3, wedge-shaped member 34 on the side locking means 28 will engage one of the channels 32, the particular channel 32 being engaged being dependent upon the relative drafts of powered vessel 11 and cargo vessel 10. Same as noted above, channels 32 possess substantially the same volume and shape as that of wedge-shaped member 34, when powered member 11 moves into the notch 18, or 22 as the case may be, of cargo vessel 10 and is fully mated thereto, the upper and lower sides of wedge-shaped member 34 will frictionally engage the upper side of one of the wedge-shaped members 31 and the lower side of an adjacent wedge-shaped member 31. Because of the tapered configuration of the locking members 31 and 34, engagement between parts 28*a* and 28*b* occurs substantially simultaneously with disengagement occurring alos substantially simultaneously resulting in the ability of powered vessel 11 and cargo vessel 10 to mate and unmate in a like fashion.

Figure 5:
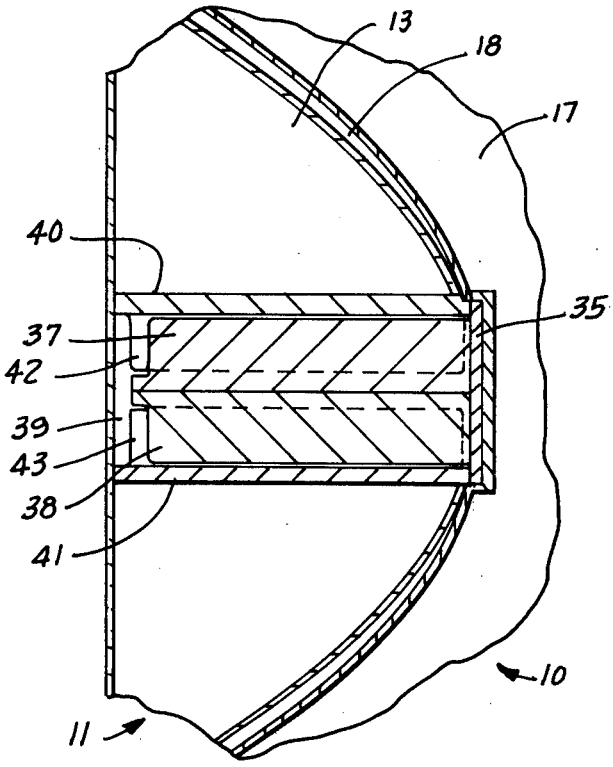
FIG. 5 is an enlarged, fragmentary view, partly in section, of the bow locking means of the combination shown in FIG. 1.

Reference is now made to FIG. 5 for a detailed description of the bow locking means 27 shown in FIGS. 1 and 2. As in the case of the side locking means 28, bow locking means 27 comprises frictionally engageable tapered members. A T-shaped member 35 is secured to cargo vessel 10 at the innermost part of notch 18 by fastening the top cross arm of T-shaped member 35 to cargo vessel 10, the long leg of T-shaped member 35 extending into notch 18 towards the aft of cargo vessel 10. Attached on both sides of the long leg of T-shaped member 35 are a series of tapered or wedge-shaped members 37 and 38 which for practical purposes are identical to wedge-shaped members 31.

Wedge-shaped members 37 and 38, like members 31, are vertically disposed above one another to form a plurality of vertically displaced wedge-shaped channels similar to channels 32 shown in FIG. 7. As in the case of part 28*a*, tapered or wedge-shaped members 37 and 38 are disposed such that their small ends point towards the aft of cargo vessel 10, the larger ends of wedge-shaped members 37 and 38 pointing towards the fore of cargo vessel 10.

Located in the bow 13 of powered vessel 11 is a generally rectangular recess 39. Mounted on both sides of recess 39, opposed and facing one another, are mounting plates 40 and 41, plates 40 and 41 being similar to plate 33 shown in FIG. 9. Affixed to plates 40 and 41 and extending into recess 39 are tapered members 42 and 43 respectively, members 42 and 43 being similar if not identical to tapered member 34 shown in FIG. 9. It will be apparent that both of wedge-shaped members 34, and members 42 and 43 will be at approximately the same relative height and that the wedge-shaped members 31 and 37 and 38 on the parts 28*a* and the T-shaped member 35 respectively will likewise be at the same relative height. Thus, when powered vessel 11 moves into mating position with cargo vessel 10, wedge-shaped members 34 on the sides of powered vessel 11 will engage appropriate channels 32 and wedge-shaped members 42 and 43 will likewise engage an appropriate channel formed between adjacent wedged-shaped members 37 and adjacent wedge-shaped members 38 respectively. This frictional engagement of the side locking means 28 and the bow locking means 27 will be substantially simultaneous and accordingly disengagement of the locking means 28 and 27 will likewise occur substantially simultaneously. As in the case noted above for parts 28*a* and 28*b*, wedge-shaped members 37, 38, 42, and 43 will generally be cast as an integral piece with T-shaped members 35 and 36 and mounting plates 40 and 41 respectively.

Figure 6:
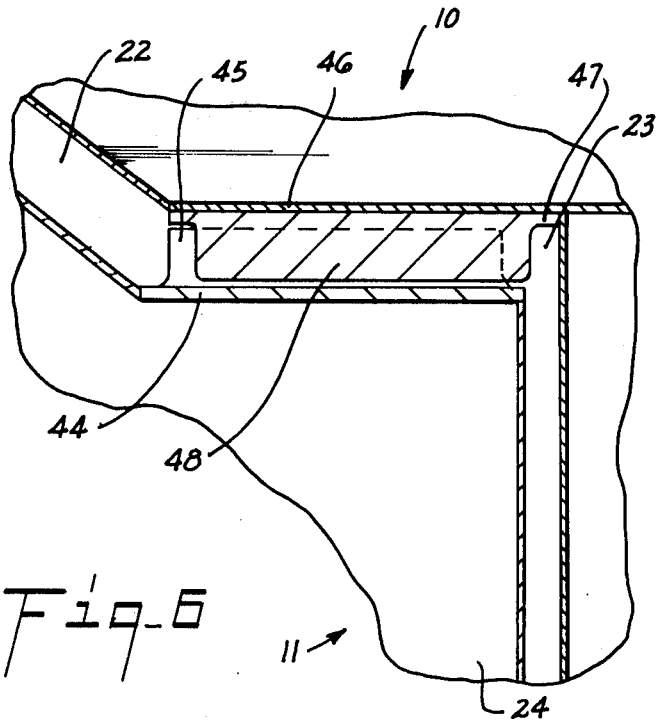
FIG. 6 is an enlarged, fragmentary view partly in section of the bow locking means of the combination shown in FIG. 3.

Reference is now made to FIG. 6 for a detailed description of the bow locking means 29 shown in the embodiment of FIGS. 3 and 4. Only one of the bow locking means between the side of protruding, squared-off bow 24 extending from powered vessel 11 and cargo vessel 10 is shown, it being understood that a like bow locking means is disposed on the opposite side of squared-off bow 24. A mounting plate 44 similar to mounting plates 40 and 41 is affixed to the side of the squared-off bow 24. Secured to plate 44 is wedge-shaped member 45 which again is substantially identical to wedge-shaped members 34, 31, 47, 38, 42, and 43. Like wedge-shaped members 42 and 43, wedge-shaped member 45 is disposed such that its smaller end points fore of powered vessel 11, its larger end pointing aft thereof. Affixed to one of the side walls 46 defining rectangular recess 23 of notch 22 is mounting plate 47, it being understood that a like mounting plate is secured to the opposed side wall defining rectangular recess 23. Protruding from the surface of mounting plate 47 are a series of vertically disposed wedge-shaped members 48, which, like member 45, are substantially identical to members 31, 34, 37, 38, 42, and 43, the relative orientations and heights of wedge-shaped members 48 being substantially the same as that of wedge-shaped members 31 shown in FIG. 8. It is thus seen that in the embodiment shown in FIGS. 3 and 4, when powered vessel 11 mates with cargo vessel 10 the locking means 28 located on either side of powered vessel 11 and the locking means 29 disposed on either side of the squared-off bow portion 24 of powered vessel 11 will simultaneously engage and disengage thus accomplishing substantially simultaneous mating and unmating of powered vessel 11 and cargo vessel 10.

It is to be observed that because of the tapered configuration of the frictionally engaging members, the members need not be of great length. The unique locking means of the present invention eliminate the need for long rubbing strakes or splines which engage correspondingly disposed channels on the side walls of the notch of the cargo vessel and which necessitate relatively long mating and unmating times. The tapered construction of the locking members permits frictional engagement and disengagement in a short period of time which for practical purposes may be considered to be substantially simultaneous as to all locking means.

While the locking means have been described above with reference to there being a plurality of wedge-shaped members on each of the cargo vessel portions of the locking means and single wedge-shaped members on each of the powered vessel portions of the locking means it is to be understood that a plurality of wedge-shaped members, vertically disposed, can also be employed on the powered vessel portion. In fact there can be as many wedge-shaped members on each of the powered vessel portions of th locking means as there are corresponding wedge-shaped channels on the cargo vessel portion of the locking means.

Figure 12:
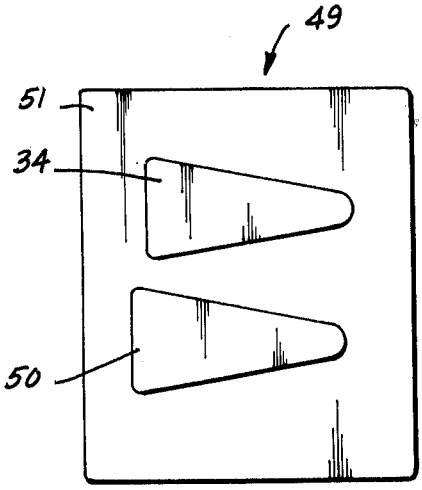
FIG. 12 is an elevational view of another embodiment of the powered vessel portion of the locking means.

In FIG. 12 is shown a slightly modified, powered vessel portion of the locking means employed herein. The modified portion shown generally as 49 is quite similar to part 28*b* shown in FIG. 5 with the exception that there are two wedge-shaped members 34 and 50 secured to mounting plate 51. Wedge-shaped member 50 is identical in size and constuction to wedge-shaped member 34; however, it is disposed such that the ends of wedge-shaped member 34 and wedge-shaped member 50 are not vertically aligned, i.e., they are horizontally displaced from one another. When secured to powered vessel 11, the orientation of wedge-shaped members 34 and 50 will be identical with that described for wedge-shaped member 34 shown in FIG. 9, i.e., the small end of wedge-shaped members 34 and 50 will point towards the fore of powered vessel 11. However, wedge-shaped member 50 which will be lowermost will be displaced slightly aft of wedge-shaped member 34 which will be uppermost. When arranged in this fashion, wedge-shaped member 50 serves as a safety lock in the event wedge-shaped member 34 is sheared off because of unusual stresses such as might be encountered under extremely heavy sea conditions. While in FIG. 12 the horizontal displacement of wedge-shaped member 50 aft of wedge-shaped member 34 appears fairly pronounced, in actual practice, wedge-shaped member 50 would be displaced only slightly as for example a few thousandths of an inch to the aft of wedge-shaped member 34. Provision of the safety lock shown in FIG. 12 is made possible by the fact that the tapered member 34 and 50 allow almost simultaneous engagement and disengagement with the corresponding locking members on the cargo vessel and therefore only a small relative horizontal displacement of the safety wedge-shaped member 50 from the primary wedge-shaped member 34 is necessitated.

Figure 10:
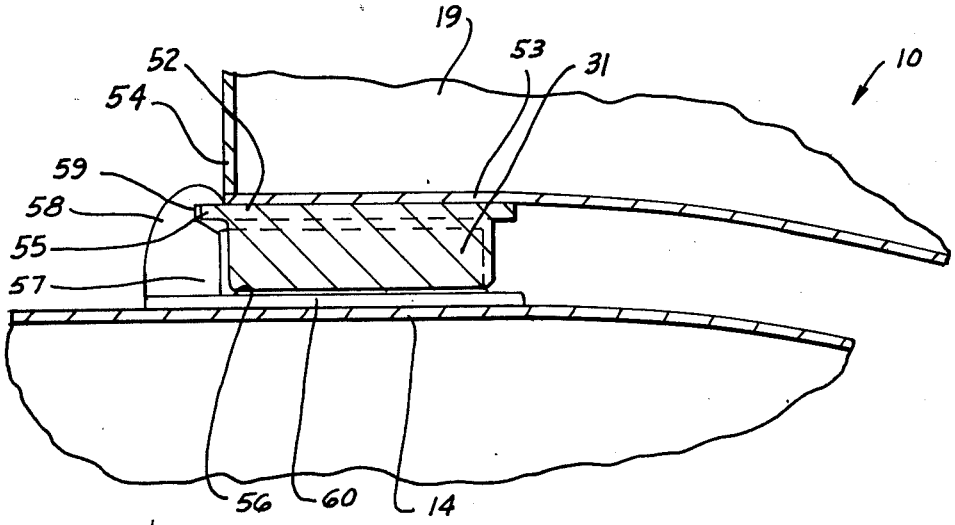
FIG. 10 is an enlarged, top view, partly in section, of the means for preventing spreading of the cargo vessel wings.
Figure 11:
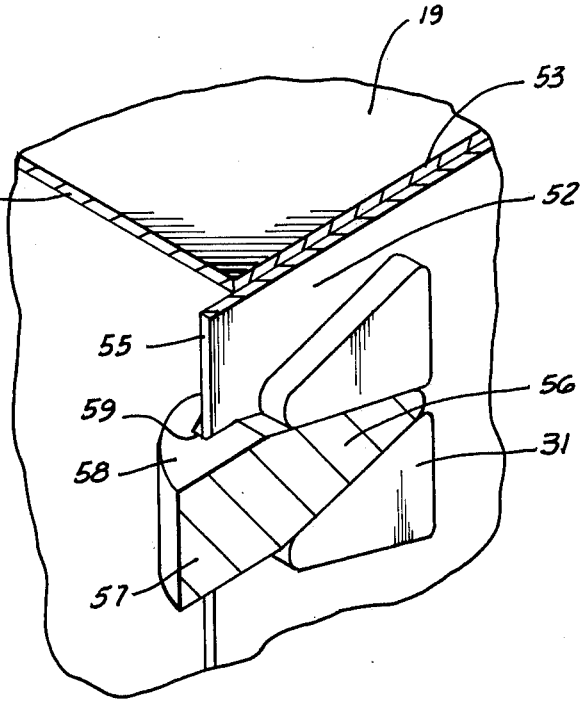
FIG. 11 is a perspective view of the means shown in FIG. 10.

In the embodiments of the present invention shown in FIGS. 1 and 3, cargo vessel 10 has a pair of stern wings 19 and 20 and 25 and 26 respectively. It will be appreciated that when the articulated ship of the present invention encounters heavy seas and/or winds, that there will be tremendous stresses placed upon the mated vessels. In particular, there may be a tendency for the stern wings whatever their precise shape to spread under the action of these severe stresses. To overcome this problem there is provided, as shown in FIGS. 10 and 11, an anti-spreading means. For purposes of illustration, the anti-spreading means is shown as applied to wing 19 of FIG. 1, it being understood that like means are employed in conjunction with wing 20 and wings 25 and 26 of the embodiment shown in FIG. 3. Referring then to FIG. 11, wedge-shaped members 31 are secured to a mounting plate 52, mounting plate 52 being somewhat wider than mounting plate 29 shown in FIG. 8. Mounting plate 52 is secured to the inside wall 53 of wing 19 such that its aft most portion extends past the end wall 54 of wing 19, i.e., past the stern of cargo vessel 10. The extension of mounting plate 52 past end wall 54 results in the formation of a vertical lip 55 projecting past the stern of cargo vessel 10. The powered vessel locking wedge mounted on powered vessel 11 is a slightly modified form of that shown in FIG. 9. In this case, the wedge-shaped member 56, secured to or integral with mounting plate 60, contains an aft projecting extensions 57 from its larger end. Projecting outwardly from extension 57 toward wing 19 of cargo vessel 10 is an arm 58 with a vertical recess or slot 59 therein. Slot 59 is disposed within arm 59 such that when powered vessel 11 mates with cargo vessel 10, lip 55 will fit into slot 59. Thus any spreading tendency of wings 19, 20, 25 and 26 will be effectively curtailed by the action of the slotted arms 58 engaging the lips 55. While slotted arm 58 is shown as being an integral part of wedge-shaped member 56, it is to be understood that slotted arm 58 need not be integral with wedge-shaped member 56 but can be a separate member affixed to the side of powered vessel 11 in a suitable fashion. Thus, when powered vessel 11 and cargo vessel 10 are mated together the wings defining the notch in the cargo vessel will be essentially prevented from any outward spreading and the tight frictional engagement of the corresponding side and bow locking mechanisms will provide an articulated ship which is rigid, which acts substantially as a unitary vessel but which is free to disengage substantially simultaneously if such becomes necessary.

It will be apparent that the exact disposition of the locking means between the cargo vessel and the powered vessel will depend upon such parameters as the weight, length, and other such dimensions but that in every case the locking means must be of sufficient strength and positioned so as to support the vessels from any relative movement when they are in the mated position. To facilitate mating and/or unmating as the case may be, various mechanical systems such as hydraulic rams, winches, cables, turnbuckles, bolts or the like may be employed. Also, once the cargo vessel and the powered vessel are in the mated position, they may be securely held together, if desired, by pins, cables, winches, dogs, hydraulic rams, or any other such means having sufficient strength to keep the vessel from separating.

In the description given above, reference has been made to the combination of a powered vessel and a cargo vessel to form an articulated ship for open water marine transportation. However, as noted, the marine combination herein can consist, if desired, of a "train" of un-powered vessels such as barges or other such cargo carrying craft. In such circumstances, one of the cargo vessels would have a suitable notch or slip in the stern portion while another cargo vessel would have a mating bow portion much as described above for the push-towing combination. The locking means employed with the two or more un-powered vessels would be identical to that described above for the powered combination. It will be recognized that in cases where the articulated ship comprises two or more unpowered vessels locked together in the manner described above, power to push or tow the vessels could be provided by a powered vessel having the features described above or by an ordinary, un-mated tug or other such vessel used to carry out marine push-towing activities.

I claim:

1. A marine transportation combination comprising a first vessel having a bow and sides and a second vessel having a notch at one end for receiving at least a portion of said first vessel, said notch having a pair of oppositely disposed wings and being open at the top and bottom, at least a portion of said first vessel being receivable in said notch between said wings, at least three individual locking means for rigidly coupling said first vessel to said second vessel, each of said locking means providing substantially point interengagement of said first and second vessels, one of said locking means comprising structure on one side of said first vessel interengageable with structure on the wing of said notch adjacent said one side of said first vessel, a second of said locking means comprising structure on the other side of said first vessel interengagable with structure on the other wing of said notch adjacent said other side of said first vessel, a third of said locking means comprising structure on the bow of said first vessel, interengagable with structure on said second vessel located generally centrally of said notch, all of said locking means having a conformation so as to permit substantially instantaneous engagement or disengagement thereof, thereby providing substantially instantaneous mating and unmating of said first and secnd vessels, and means for preventing spreading of said wings of said notch once said first vessel and said second vessel are in the mated position, said means for preventing spreading comprising a first structural formation on said one side of said first vessel, a second structural formation on said other side of said first vessel, a third structural formation on one of said wings closely adjacent the stern portion thereof and a fourth structural formation on the other of said wings closely adjacent the stern portion thereof, said first and second structural formations engaging said third and fourth structural formations, respectively, when said locking means interengage and said first and second vessels are mated, said structural formations being disengagable by relative movement of said first and second vessels away from one another, said structural formations being rigid and preventing any substantial lateral outward movement of said wings when said first and second vessels are mated.

2. The marine transportation combination of claim 1 wherein said locking means includes means permitting a multiplicity of relative draft engagements of said first and second vessel.

3. The marine transportation combination of claim 1 wherein said first vessel comprises a powered vessel and said second vessel comprises a cargo vessel.

4. The marine transportation combination of claim 1 wherein said structure of each of said locking means on said first vessel defines at least one tapered member, the smaller end of said tapered member pointing fore of said first vessel, and the structure of each of said locking means on said second vessel defines at least one tapered channel, the smaller end of said tapered channel pointing fore of said second vessel, said tapered members mating with said tapered channels when said first and second vessels are in said mated position.

5. The marine transportation combination of claim 1 wherein there are a plurality of said tapered channels, vertically disposed.

6. The marine transportation combination of claim 1 wherein said means for preventing spreading of said wings comprises a pair of vertical lips extending aft of the stern of said second vessel and on opposite sides of said notch and a pair of slotted arms mounted on each side of said first vessel, the slots in said arms engaging said vertical lips on said sides of said notch when said first and second vessels are in the mated position.

7. The marine transportation combination of claim 1 wherein said structure of each of said locking means on said first vessel further defines at least one additional tapered member, the smaller end of said additional tapered member pointing fore of said first vessel, said additional tapered member being disposed slightly aft and below the remainder of said tapered members to thereby form a safety locking means should any of said remaining tapered members fail.

* * * * *

UNITED STATES PATENT AND TRADEMARK OFFICE

CERTIFICATE OF CORRECTION

PATENT NO. : 4,013,032

DATED : March 22, 1977

INVENTOR(S) : Robert A. Bludworth

It is certified that error appears in the above-identified patent and that said Letters Patent are hereby corrected as shown below:

In Column 2, line 42, delete the word "of" and insert therefor --or--.

In Column 4, line 53, delete the word "alos" and insert therefor --also--.

In Column 5, line 51, delete the number "47"and insert therefor --37--.

In Column 7, line 31, delete the number "59" and insert therefor --58--.

In Column 8, line 42, delete the word "secnd" and insert therefor --second--.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*